United States Patent [19]

Wesson et al.

[11] 3,965,988

[45] June 29, 1976

[54] FIRE EXTINGUISHING METHOD AND APPARATUS

[75] Inventors: Harold R. Wesson; Lester E. Brown; Gregory L. Puckett, all of Norman, Okla.

[73] Assignee: University Engineers, Inc., Norman, Okla.

[22] Filed: Dec. 13, 1974

[21] Appl. No.: 532,407

[52] U.S. Cl. ..... 169/9; 169/77; 169/85; 222/195; 239/143

[51] Int. Cl.[2] ..... A62C 13/38

[58] Field of Search ..... 169/9, 43, 5, 71, 77, 169/85; 222/193, 195; 239/142, 143

[56] References Cited

UNITED STATES PATENTS

| | | | |
|---|---|---|---|
| 2,473,349 | 6/1949 | Snowden | 169/9 X |
| 2,742,970 | 4/1956 | Bauman et al. | 169/11 |
| 2,818,121 | 12/1957 | Clifford et al. | 169/9 |
| 2,923,360 | 2/1960 | Porter | 169/9 X |

*Primary Examiner*—Evon C. Blunk
*Assistant Examiner*—Michael Mar
*Attorney, Agent, or Firm*—Laney, Dougherty, Hessin & Fish

[57] ABSTRACT

A chemical fire extinguishing apparatus which includes a chemical storage chamber, chemical discharge conduct connected to the chamber for conveying and distributing the chemical, and a source of relatively high pressure gas connected to the chamber and communicating with the interior thereof to agitate and fluidize the extinguishing chemical by impingement of high pressure gas. Upon agitation and fluidization, gas is delivered then to the chamber at a lower pressure to entrain the chemical in a constant, relatively low pressure gas stream flowing from the chamber to the chemical discharge conduit.

14 Claims, 6 Drawing Figures

FIRE EXTINGUISHING METHOD AND APPARATUS

BACKGROUND OF THE INVENTION

1. Field of the Invention

This invention pertains to a chemical fire extinguishing apparatus in which the chemical extinguishing agent is fluidized by an inert gas and is discharged as a fluidized stream. More particularly, the invention relates to a method and apparatus for rapidly agitating and dispersing the chemical extenguishing agent within a storage facility and then discharging the chemical extinguishing agent at a controlled rate by means of fluidizing stream of a relatively lower pressure gas.

2. Brief Discription of the Prior Art

In dry chemical fire extinguishing systems, the concept of providing a storage location for a dry chemical fire extinguishing agent and connecting such storage location to a source of a gaseous fluidizing agent under pressure is well known. Thus, in U.S. Pat. Nos. 3,463,235 and 3,463,236, a cartridge of carbon dioxide is connected to the chemical storage drum or chamber. In order to deliver the extinguishing agent, the cartridges are punctured, and the pressurized carbon dioxide gas is admitted to the storage chamber to pick up and entrain the dry chemical extinguishing agent. In a different arrangment, a frangible disc employed to contain the gas under pressure is cut by a plunger in the manner shown in U.S. Pat. No. 2,778,434, or a frangible strip holding a removable ring pin is severed as shown in U.S. Pat. No. 3,061,194 for the purpose of releasing carbon dioxide. A cam-plunger arrangement has been proposed in U.S. Pat. No. 3,088,522 for the purpose of actuating the fire extinguishing system, utilizing pressurized gas. It has been proposed also to agitate and disperse the dry chemical fire extinguishing agent by inverting a drum or vessel which contains the agent at the time when it is to be entrained in a gaseous stream and delivered through distributing conduits. This concept is set forth in U.S. Pat. Nos. 2,923,360; 3,040,816; and 3,375,875.

In systems of the type described, the actuation of the fire extinguishing system is dependent upon the use of a stored pressurized gas which is released at the time of need to agitate and disperse the extinguishing agent within a storage facility, and also to entrain that agent in a moving gas stream directed to the fire. In other systems, the described agitation and dispersement to allow the agent to be picked up and carried in the gas stream is accomplished by inversion or mechanical movement of the storage container. In the type of actuation initially referred to, difficulties are sometimes encountered because of the inability of the pressurized gas to adequately disperse the dry chemical extinguishing agent which has become compacted or settled within the storage container. The pressure of the gas employed for this purpose and then subsequently for entrainment of the extinguishing agent does not afford sufficient shock and disturbance forces to break up and thoroughly disperse and agitate the chemical to allow adequate entrainment.

Where mechanicl movement of the drum or chamber is relied upon for agitating and dispersing the chemical extinguishing agent sotred therein, there must be provided relatively complicated mechanical systems involving heavy trunions, and frequently various types of hydraulic equipment, to effect the inversion of the chamber or otherwise move it in a way to agitate the stored chemical.

BRIEF DESCRIPTION OF THE PRESENT INVENTION

We have now determined that chemical fire extinguishing systems can be provided which include a large storage facility for the extinguishing agent and which do not require inversion or other movement of the container to agitate and disperse the chemical prior to its entrainment in a coneying gas stream. Moreover, our system does not require mechanical opening or piercing devices for actuating the gas source in such a way that the devices must be replaced prior to each use of the system.

Broadly described, the apparatus of the present invention includes a pressure vessel or chemical storage chamber for containing the extinguishing chemical, a discharge means for conveying the extinguishing chemical from the chamber to the point of use for extinguishing a fire, and one or more sources of gas under pressure. When more than one source is used, at least one source is adapted to convey gas to the interior of the storage chamber at a relatively high pressure, and at least one other is adapted to convey gas to the interior of the chamber at a relatively low, preferably constant pressure. In using the latter system, one high pressure gas source is actuated initially to deliver high pressure gas to the interior of the chamber so that the extinguishing agent is thoroughly agitated and fluidized preparatory to discharge through the chemical discharge means. After such initial agitation and fluidization, the second gas source is actuated to charge gas at a relatively low, constant pressure to the storage chamber. Here it fluidizes and entrains the extinguishing agent and delivers it through the chemical discharge conduit means to a point of discharge and use in fire extinguishment.

In a preferred embodiment of the invention, means is provided for automatically admitting the fluidizing gas at a relatively low, constant pressure to the storage chamber after the relatively high pressure actuating gas has been admitted to the chamber and the chamber has been pressurized. This pressurization is accompanied by a concurrent drop in pressure in the source of high pressure actuating gas and the conduit connecting it with the chamber. Stated differently, means is provided for automatically admitting gas at a lower pressure to the chamber at a time after the initial introduction of high pressure gas. At this time, the overall pressure of the actuating gas system has dropped to a predetermined level following the initial agitation and dispersement of the extinguishing agent and pressurization of the storage chamber.

An important object of the present invention is to provide a fire extinguishing apparatus which operates by delivering a chemical extinguishing agent in a fluidized stream from a storage location to the point of use for extinguishing the fire, which system and apparatus do not employ frangible or destructible mechanical devices requiring replacement after each use, and do not require any inversion or other movement of the chemical storage chamber in order to agitate, disperse, and fluidize the extiguishing agent.

A further object of the invention is to provide a fire extinguishing system utilizing a fluidized fire extinguishing chemical and providing a steady flow of fluidizing gas which entrains the chemical and conveys it from a storage facility through a conduit system to a point of discharge.

Another object of the invention is to provide a simple, mechanically reliable fire extinguishing apparatus which may be used repeatedly without any requirement for replacing internal parts, and which can be operated by persons having little training and using few manipulative actions.

Another object of the invention is to provide a high performance, low cost, dry chemical fire fighting system utilizing a gas-entrained dry chemical fire extinguishing agent delivered to the point of use by a constant pressure gas stream.

Another object of the invention is to provide a portable dry chemical fire extinguishing system which may be used with close-coupled hose reels, remote hose reels, turret nozzles, or a fixed pipe-nozzle network for the purpose of delivering the dry chemical to the point of use in extinguishing a fire.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
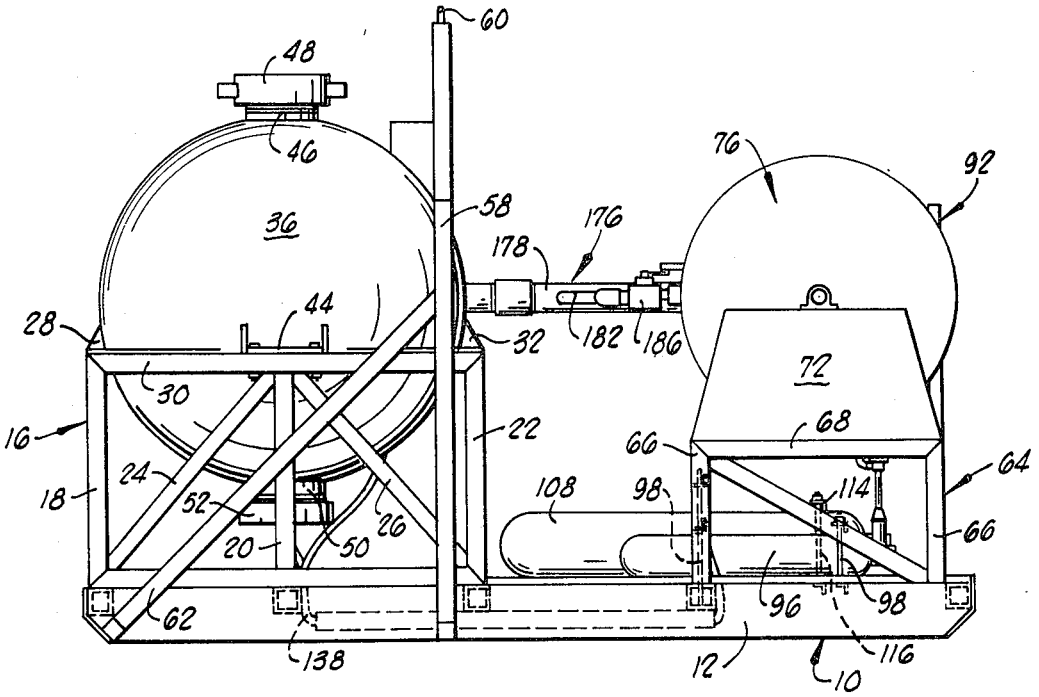
FIG. 1 is a side elevation view of one embodiment of a fire extinguishing apparatus constructed in accordance with the present invention. Certain portions of the conduit or piping system which are obscured from view behind other structures are illustrated in dashed lines.

Referring initially to FIG. 1, the fire extinguishing apparatus of the invention, in one form thereof, includes an elongated skid base 10 which includes elongated runners 12 and 14 disposed on opposite sides of the skid base. The runners 12 and 14 are interconnected by transverse members 15. Mounted on one end portion of the skid base 10 is an upright drum supporting framework, designated generally by reference numeral 16. The drum supporting framework 16 includes upright frame members 18, 20, and 22, diagonal frame members 24 and 26, and a plurality of drum supporting top horizontal frame members 28, 30, 32 and 34.

Figure 2:
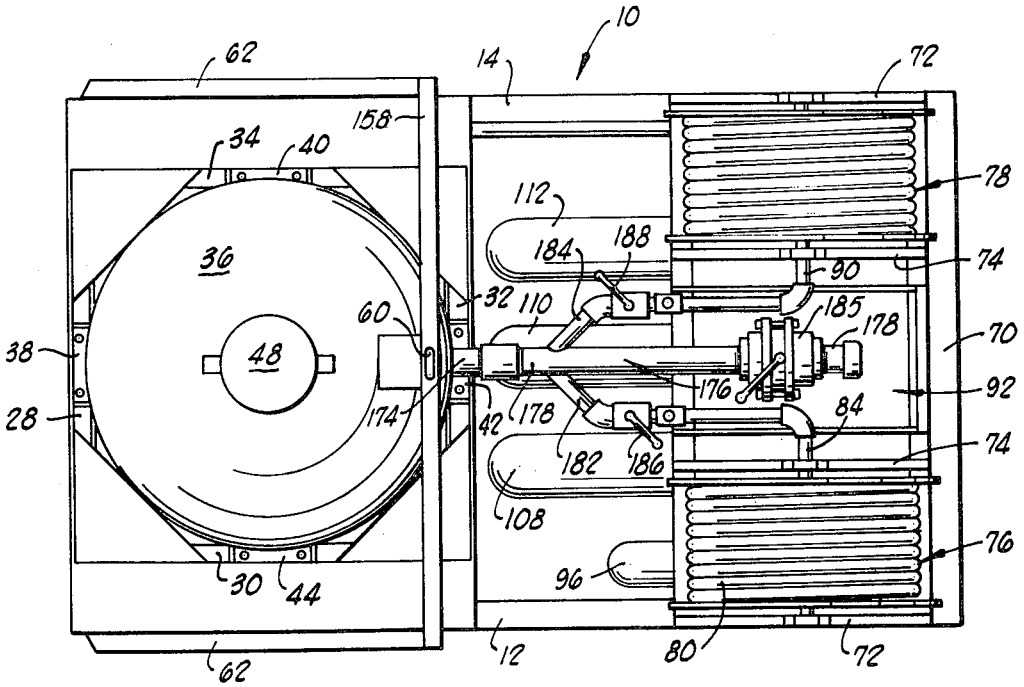
FIG. 2 is a plan view of the fire extinguishing apparatus shown in FIG. 1.
Figure 3:
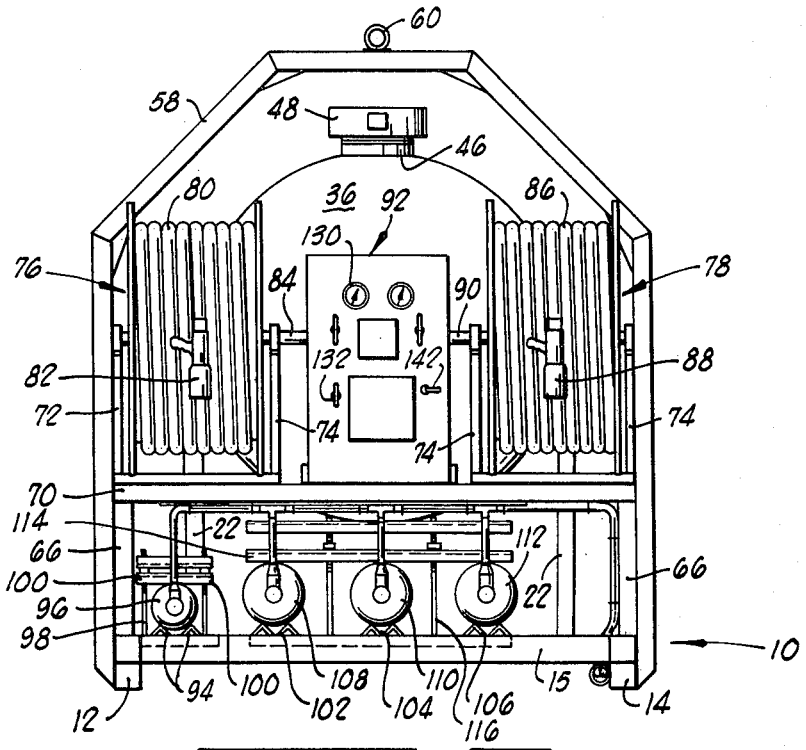
FIG. 3 is an end elevation view of the fire extinguishing system as depicted in FIG. 1.
Figure 5:
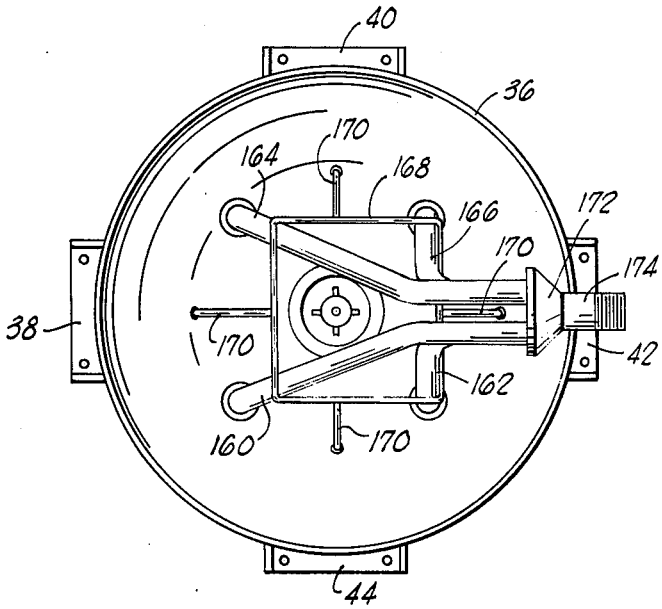
FIG. 5 is a horizontal sectional view taken through the center of the spherical storage drum depicted in FIG. 4.

Supported within the drum supporting framework 16 is a pressure vessel storage drum 36. In the illustrated embodiment, the storage drum 36 is a spherical container having mounting flanges 38, 40, 42 and 44 secured on opposite sides thereof for supporting and mounting the storage drum on the frame members 28-34 as shown in FIGS. 1, 2 and 5. On the upper side of the storage drum 36, the drum is provided with a threaded filling neck 46 which is closed by a threaded cap 48. At its lower side, the drum 36 is provided with a threaded discharge neck 50 which is closed by a closure cap 52. The closure cap 52 carries a gas injection pipe 54 having a multi-port discharge head 56 secured on the internal end thereof for a purpose hereinafter described.

A U-shaped lift bar 58 is secured to the skid base 10 at a location such that the center of gravity of the fire extinguishing apparatus will act downwardly through the plane in which it is located. The lower ends of the lift bar 58 are joined to the elongated runners 12 and 14, and the crown or web portion of the lift bar carries an eye 60 which can be utilized for lifting the entire fire extinguishing apparatus upwardly by means of a crane or similar lifting device. The lift bar 58 is braced and reinforced by suitable diagonal brace members 62 which extend between central portions of the lift bar and one end of the skid base 10.

Mounted on the opposite end of the skid base 10 from the drum supporting framework 16 is a reel support frame designated generally by reference numeral 64. The reel support frame 64 includes a plurality of upright frame members 66 which project upwardly from the skid base 10 and are interconnected at their upper sides by horizontal side frame members 68 and transverse frame members 70. A pair of reel support brackets which each include end plates 72 and 74 are provided at opposite sides of the reel support frame 64 and project upwardly therefrom to receive a pair of hose reels designated generally by reference numerals 76 and 78. The hose reel 76 has wound thereupon an elongated flexible hose 80 which terminates in a nozzle 82. The other end of the hose 80 is connected to a pipe 84 projected into the reel along the axis of rotation thereof and coupled to the hose for feeding fluidized fire extinguishing agent thereto. In like manner, the reel 78 has wound thereon an elongated flexible hose which has one of its ends connected to nozzle 88 and its other end connected to a charging pipe 90 which extends into the center of the reel coincident with the axis of rotation thereof. Supported on the reel support framework 64 between reels 76 and 78 is a control panel designated generally be reference numeral 92.

Mounted on the upper side of the transverse members 15, along one side of the skid base 10, are a pair of substantially parallel cradle angles 94. The cradle angles 94 support a storage cylinder 96 of inert gas, such as nitrogen, maintained under high pressure. Two pairs of vertically extending hold-down rods 98 are provided along the length of the cylinder 96 and on opposite sides thereof to facilitate the retention of the cylinder on the angles 94 by means of adjustably positioned hold-down bars 100.

In the embodiment shown, in addition to the hold-down structure as thus described for positioning and retaining the high pressure gas storage cylinder 96, a plurality of spaced pairs of elongated cradle angles 102, 104 and 106 are provided, and extend across the upper sides of the transverse members 15. The cradle angle pairs 102–106 support, respectively, three cylinders, 108, 110 and 112, each containing an inert fluidizing gas which can be under substantially the same pressure as the gas in the storage cylinder 96. A hold-down bar 114 is provided for engaging the upper sides of the cylinders 108, 110 and 112, and is adjustably positioned on a pair of vertically extending, externally threaded hold-down rods 116 and 118.

Figure 6:
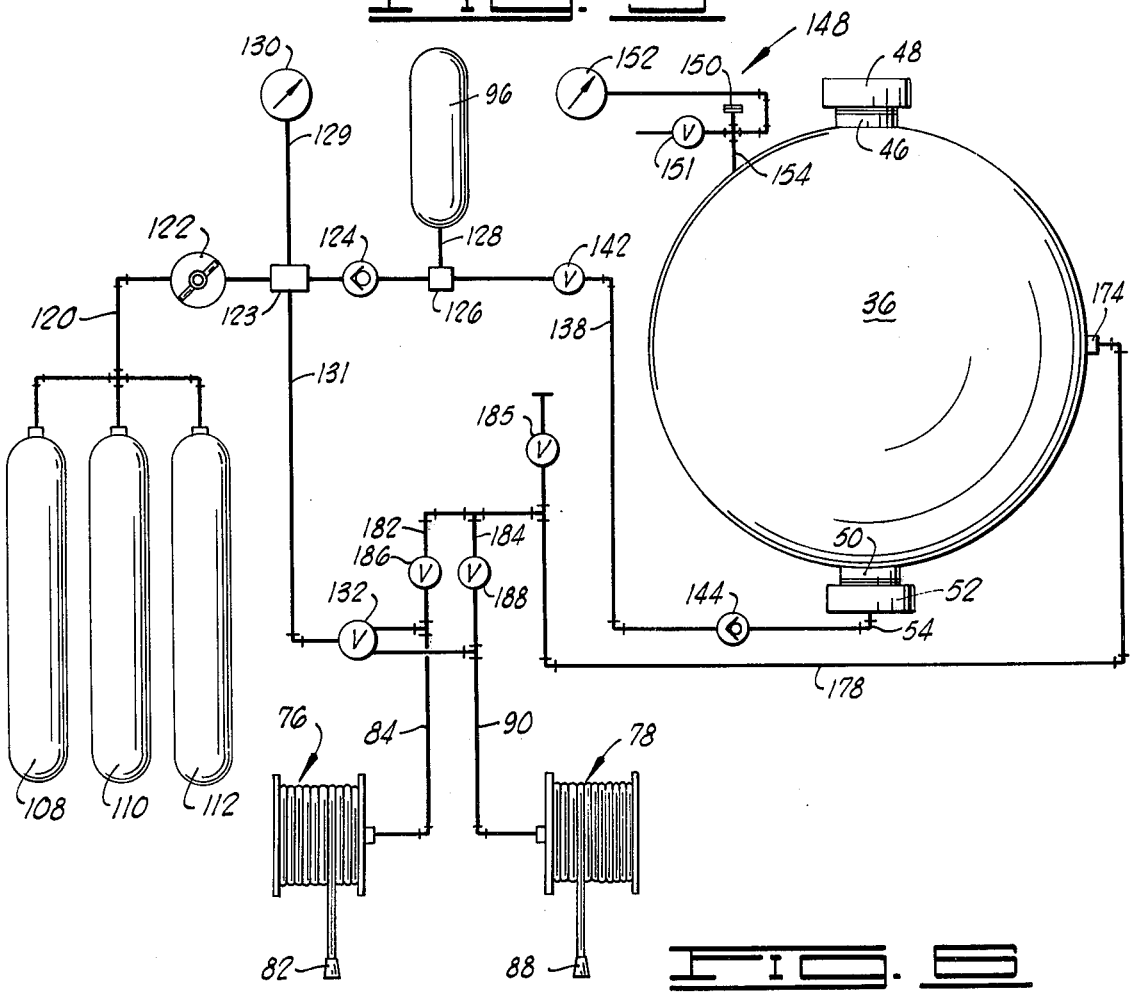
FIG. 6 is a schematic gas flow diagram illustrating diagrammatically the sources employed in the illustrated embodiment of the present invention, and the manner in which such sources are connected to the spherical storage drum and the discharge conduits used in the apparatus.

The conduit system which is utilized for conveying the gases from cylinders 96, 108, 110 and 112, respectively, to the storage drum 36 is schematically illustrated in FIG. 6. Thus, the gas cylinders 108, 110 and 112 are manifolded to a conduit 120 which is connected through a gas pressureregulator valve 122, a four way fitting 123, and a check valve 124 to a fitting 126, which is connected also to a conduit 128 functioning to convey gas from the cylinder 96 to the fitting 126. Connected to the fitting 123 is a conduit 129, which is connected to a pressure gauge 130, and a conduit 131, which is connected to a manual selector valve 132. The manual selector valve 132, disposed on the control panel 92, is connected through conduits 134 and 136 to the pipes 84 and 90 for the purpose of cleaning the hose lines of the extinguishing agent after the extinguisher has been in service.

A conduit 138 is connected to the third port of the three-way fitting 126 and extends through a main valve 142, also mounted on the control panel 92, and a check valve 144, to the gas injection pipe 54 extending into the lower side of the pressure vessel storage drum 36. Secured to an upper portion of the drum 36 is a pressure relief and indicator system designated generally by reference numeral 148. The pressure relief and indicator system 148 includes a relief valve 150, a manual bleed valve 151, and a pressure indicator gauge 152. The relief valve 150, manual bleed valve 151, and pressure indicator gauge 152 are placed in communication with the interior of the drum through a conduit 154.

Figure 4:
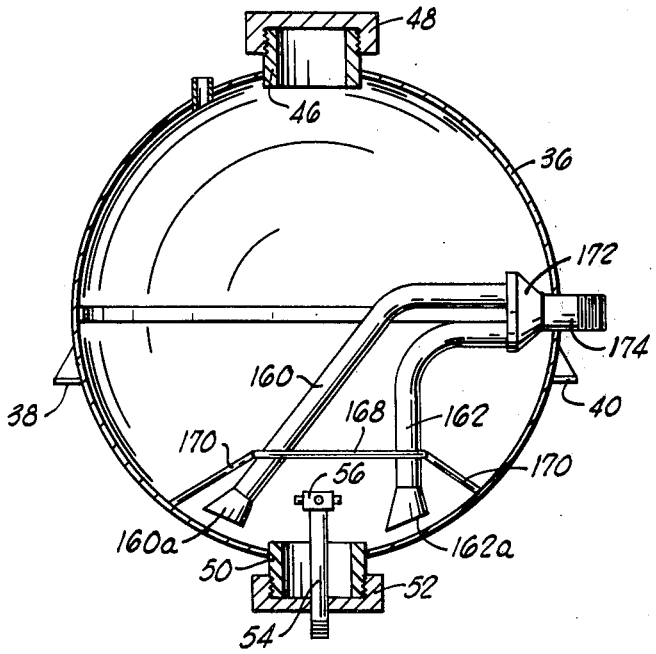
FIG. 4 is a vertical sectional view taken through the center of the spherical storage drum forming a portion of the apparatus of the present invention.

As previously indicated, gas from the pressure cylinders is sequentially introduced to the pressure vessel storage drum 36 via the pipe 54 and the multi-ported discharge head 56 disposed within the drum. The distribution system employed for picking up the fluidized fire extinguishing agent and transmitting it to the flexible hoses 80 and 86 disposed upon the reels 76 and 78 is best illustrated in FIGS. 2, 4 and 5 of the drawings. A plurality of pickup pipes 160, 162, 164 and 166 project downwardly in the drum 36 and terminate in flared pickup heads, such as the heads 160*a* and 162*a* shown in FIG. 4 of the drawings. The pickup pipes 160–166 are retained in a stationary position and reinforced against vibration by means of a rectangular retainer frame 168 made of rod or bar stock, and supported in spaced relation to the bottom of the drum by means of a plurality of diagonal rods 170 (See FIGS. 4 and 5).

Pickup pipes 160-166 extend into a collecting manifold 172 which has a threaded tubular extension 174 projected through the side of the drum 36. The threaded tubular extension 174 is coupled to the flexible hoses 80 and 86 through a branched distribution conduit sub-assembly designated generally by reference numeral 176. The distribution sub-assembly 176 includes a main pipe 178 having a pair of branch conduits 182 and 184 branching therefrom, and having a deluge valve 185 positioned near the capped end of the main pipe 178 for a purpose hereinafter described. The branch conduits 182 and 184 are connected through manually operable on-off valves 186 and 188 to the pipes 84 and 90 which are each connected to one end of the hoses 80 and 86, respectively, on the reels 76 and 78, respectively, as hereinbefore explained. Valves 186 and 188 are not required when the system is set up as a live hose reel system.

OPERATION

In the operation of the fire extinguishing apparatus of the invention, the active fire extinguishing agent, which is preferably, although not necessarily, in dry powder form, is stored in the storage drum 36. Drum 36 is filled by removing the threaded cap 48 and introducing the extinguishing agent through the top of the drum. At this time during the filling of the drum, and prior to the use of the fire extinguishing apparatus, the manually operable on-off valves 186 and 188 are closed, as are the main valve 132 and the manual selector valve 144.

As will be apparent from the foregoing description of one embodiment of the invention, two sources of nonreactive gas are provided in the system, although a single source used in conjunction with appropriate valving can be employed in other embodiments. In the illustrated embodiment of the invention, these sources are the storage cylinder 96 and the storage cylinders 108, 110 and 112. The latter cylinders will be hereinafter sometimes referred to as the main source, and the cylinder 96 will sometimes be referred to as the secondary source. A suitable gas for use in carrying out the method of the invention is nitrogen. Typically, the pressure of the gas in the cylinders may be from about 500 psi to about 2600 psi, although this range is not meant to be limiting, since one embodiment of the invention simply entails the use of an unregulated gas source and a regulated gas source as will be hereinafter described. In the illustrated embodiment of the invention, both the main gas source and the secondary source charge the nonreactive gas to the pressure vessel storage drum 36 through the common conduit 138.

To commence operation of the system for the extinguishment of a fire, the main valve 142 is opened. This establishes communication between the unregulated gas cylinder 96 and the drum 36 so that relatively high pressure gas from the secondary source can pass at its storage pressure to the pressure vessel storage drum 36 and impinge upon the extinguishing agent in the drum. In the event that the particles of the agent have become packed in the lower portion of the drum, the initial burst of high pressure gas from the secondary source will unpack these particles, agitate, and disperse them before second stage fluidization and entrainment by the gas from the primary source. After the initial burst of high pressure gas from the secondary source, the pressure will build up in the drum 36 and will drop throughout the remainder of the system, including conduit 138 and cylinder 96. As the pressure of gas discharged from the cylinder 96 through the conduit 128, fitting 126, and conduit 138 decreases, a pressure level is ultimately reached at which the check valve 124 can open because the pressure from the regulated main source exceeds that on the downstream side of the check valve. At this time, nonreactive gas, under pressure from the primary source constituted by cylinders 108, 110 and 112, passes though the pressure regulator valve 122 and enters conduit 138 at a constant regulated pressure. The regulator valve 122 has been selectively preset prior to this time for establishing a pressure level in conduits 120 and 138 and in drum 36 such that the chemical extinguishing agent will be fluidized and entrained and carried to the location of the fire at the desired pressure.

The initial burst from the secondary gas source followed by flow of relatively lower, constant pressure gas from the main source to drum 36 occurs relatively rapidly. Therefore, after opening the main valve 142, one or more operators of the system can pull or unreel one or both of the hoses 80 and 86 from hose reels 76 and 78, bringing the nozzles of the hoses to the discharge location. With the hoses thus positioned, one or both of the manual on-off valve 186 or 188 are opened (when not operated as a live reel system). This permits fluidized extinguishing agent to be picked up by the pickup pipes 160–166 and passed through the manifold 172 to the branch conduit distribution system 176 and into hoses 80 and/or 86. The regulation of the pressure of the gas from the main source results in a smooth, continuous discharge of the fire extinguishing agent.

It will be noted from the foregoing description of one embodiment of the fire extinguishing apparatus of the invention that, where a common conduit system is provided for conducting gas from both the primary and secondary source to the storage drum 36, the check valve 124 which is provided in conjunction with the pressure regulator valve 122 functions to prevent flow of unregulated, relatively high pressure gas back to the regulator valve or the pop-off or relief valve (not shown) provided as a part of the regulator valve. The check valve 127 prevents flow of gas from the main source to the drum 36 until the pressure of gas from the secondary source has dropped to a slightly lower level than the regulated pressure of the gas from the main source.

After use, the main valve 142 and valves 186 and 188 are closed and the manual selector valve 132 is opened so that purging gas can pass into the branch conduits 84 and 90. By opening selector valve 132 at this time, clean purge gas can be passed through the flexible hoses 80 and 86 (or their equivalent) to clean them and remove any residual dry chemical extinguishing agent. Thus, the system is cleaned for use at a later time.

In an alternate method of usage of the illustrated embodiment of the invention, the cap at the end of the main pipe 178 is removed and the main pipe is here connected to a fixed distribution system. With the valves 186 and 188 closed, the deluge valve 185 can then be opened after the main valve 142 is opened to discharge the extinguishing agent through the fixed distribution system.

It should be pointed out that in order to restore the system to its ready status, all that is needed is to replenish the dry chemical extinguishing agent in the drum 36 and to recharge the gas cylinder or cylinders. It is not necessary to replace any frangible or sheared elements because these are not required or utilized in the system of the invention.

The following example illustrates the operation of the illustrated embodiment of the fire extinguishing apparatus of the invention. In such example, the conditions represent typical operating conditions and are in no way limiting as to the scope of the invention or restrictive relative to the possibility of employing other operating conditions.

The sytem was selectively adjusted to provide a constant operating pressure for fire extinguishing of 250 psi by setting this pressure on the gas pressure regulator valve 122. Nitrogen gas was stored in the cylinders 96, 108, 110 and 112 at a pressure of 1700 psi. When the system was actuated by opening main valve 142, gas flowed from the non-regulated secondary source (cyinder 96) and agitated and dispersed a dry powder chemical extinguishing agent stored in the pressure vessel storage drum 36. The drum was pressurized to 200 psi in less than 20 seconds.

As the supply of the non-regulated gas diminished and the gas pressure in the conduit system connecting the cylinder 96 with the drum 36 decreased, the check valve 124 opened to allow gas at a regulated pressure of 250 psi to pass to the drum 36. In less than 30 seconds from initial actuation of the system, a constant operating pressure of 250 psi was achieved. In this test, one-inch flexible hoses equipped with nozzles were used and delivered 10 pounds per second of the powder extinguishing agent until more than 85 percent of the total dry chemical charge contained within the drum 36 had been delivered. The total delivery was greater than 95 percent of the dry chemical charged.

The foregoing description and reference to the accompanying drawings comprises an explanation of the principles of the invention by alluding to one form which the apparatus may take. It will be appreciated, however, that various alterations of structure, and changes in the arrangement of such structure, can be effected without departure from the basic principles of the process and of the apparatus which are considered to be inventive. Thus, although a common conduit conveyance system has been described as used for conveying gas from the secondary and primary sources, it will be appreciated that two different and separate conduits could be provided if desired. Moreover, the gas has been shown and described as being charged to the bottom portion of the drum 36, but it will be appreciated that the conduits could enter the drum at other levels, including the top thereof, and could be spaced different distances from the bottom of the drum, provided only that the functions of the dispersement and agitation, followed by fluidization, are adequately achieved. Further, though the apparatus has been illustrated and described as mounted upon a skid base for portability, the fire extinguishing apparatus can be mounted in a fixed position for use at a specific, fixed location, or, alternately, upon other types of movable structures, such as a truck or vehicle that may be used to mount the apparatus so that it can be relocated easily and at will. The type of projected use of the apparatus will, in most instances, determine largely the type of discharge means which is used with the apparatus, e.g., manifolds, hose and nozzle arrangements, etc. Although multiple sources of gas have been described, it is possible to use a single large source of gas with appropriate valving and lines which would initially discharge gas at high pressure to the storage drum and then, responsive to a change in the system (such as the pressure in the dry chemical storage drum), switch the passage of gas through the pressure regulator so that the gas would, from that time on, be delivered at constant pressure to the drum.

It will thus be seen that various changes of structure and form can be effected without departure from the basic principles which underlie the invention. Such changes are therefore deemed to be circumscribed by the spirit and scope of the invention except as the same may be necessarily limited by the appended claims, or reasonable equivalents thereof.

What is claimed is:

1. A fire extinguishing apparatus comprising:

a pressure vessel containing a solid particulate chemical fire extinguishing agent;

an injection pipe projecting through the lower side of the pressure vessel and terminating in the lower-most portion of the solid particulate chemical fire extinguishing agent in the pressure vessel;

a first source of gas under pressure connected to said injection pipe;

means for selectively and automatically regulating the pressure of gas delivered from said first source to said injection pipe;

a second source of gas connected to said injection pipe, said second gas source including a supply of gas at a relatively higher pressure than the regulated pressure of gas from said first source;

discharge means connected to said pressure vessel for delivering said solid particulate extinguishing agent from said pressure vessel to the situs of a fire; and means automatically responsive to a property of the gas originating at said second source to sequentially communicate with the injection pipe, initially the second source of gas and subsequently the first source of gas, whereby gas flows at such subsequent time, at a constant pressure through said discharge means.

2. A fire extinguishing apparatus comprising:

a pressure vessel for containing a chemical fire extinguishing agent;

a main gas source for supplying gas at a relatively low pressure as compared to the pressure of gas from a secondary gas source hereinafter described;

a secondary gas source for supplying gas at a pressure which is higher than the pressure of gas from said main source;

a common conduit system for conveying gas from said main and secondary gas sources to said pressure vessel;

a check valve in said common conduit system for preventing gas flow from said secondary source toward said main source, but allowing flow from said main source to said pressure vessel at a time when the pressure of gas in said conduit system between said pressure vessel and said secondary source has dropped to a level lower than that in the common conduit system between the main gas source and the check valve; and means for conveying a fluidized quantity of said chemical fire extinguishing agent from said vessel to the site of a fire to be extinguished.

3. A fire extinguishing apparatus as defined in claim 2 and further characterized as including a pressure regulator valve between said check valve and said main gas source for controlling the flow of gas from said main gas source to said pressure vessel to assure flow from said main source to said pressure vessel at substantially constant pressure after the pressure of gas from said secondary source drops below a predetermined level.

4. A fire extinguishing apparatus as defined in claim 3 wherein said means for conveying a fluidized quantity of chemical fire extinguishing agent comprises:

at least one extinguishing agent pickup pipe in said pressure vessel; and a flexible hose outside said pressure vessel and connected to said pickup pipe.

5. A fire extinguishing apparatus as defined in claim 4 and further characterized as including:

a skid supporting the pressure vessel, said conduit system, said main and secondary gas sources, said check valve and said regulator valve; and dry chemical distributing means supported on said skid for movement therewith.

6. A fire extinguishing apparatus as defined in claim 5 and further characterized as including means for purging said distributing means after the fire has been extinguished.

7. A fire extinguishing apparatus as defined in claim 6 wherein said purging means comprises a conduit system bypassing said pressure vessel for charging gas from one of said sources directly to said distributing means.

8. A fire extinguishing apparatus as defined in claim 5 wherein said conveying means is further characterized in including:

a plurality of said pickup pipes terminating adjacent the bottom of said pressure vessel; and a collecting manifold connected to said pickup pipes and extending through the wall of said pressure vessel for connection to said distributing means.

9. A fire extinguishing apparatus comprising:

a pressure vessel for containing a chemical fire extinguishing agent;

means for conveying a fluidized quantity of said chemical fire extinguishing agent from said vessel to the site of the fire to be extinguished;

means for automatically introducing to said pressure vessel, in sequence, a first gas charge to agitate and disperse said extinguishing agent and pressurize the vessel, and then a second gas charge at a relatively lower pressure than the pressure at which said first gas charge is initially introduced to said vessel for fluidizing said extinguishing agent and moving it through said conveying means, said means for automatically sequentially introducing said first and second charges to said pressure vessel comprising:

a common conduit for conveying said firt and second gas charges to said pressure vessel; and a pressure regulator valve for admitting said second gas charge to said common conduit at a time after said first gas charge has been admitted thereto, and such latter admission of gas has resulted in a lower pressure on the opposite side of said pressure regulator valve than the pressure on the side thereof which receives said second gas charge.

10. A fire extinguishing apparatus comprising:

a pressure vessel for containing a chemical fire extinguishing agent;

means for conveying a fluidized quantity of said chemical fire extinguishing agent from said vessel to the site of the fire to be extinguished;

a main gas source for supplying gas to said pressure vessel;

a secondary gas source for conveying gas to said pressure vessel; and gas flow regulating means for controlling the flow of gas from said main gas source to said pressure vessel to allow flow from said main source to said pressure vessel at a substantially constant pressure after the pressure of gas from said secondary source has dropped below a predetermined level.

11. A fire extinguishing apparatus as defined in claim 10 and further characterized as including:

a skid supporting the pressure vessel and said automatic introducing means; and dry chemical conveying means supported on said skid for movement therewith.

12. A fire extinguishing apparatus as defined in claim 10 and further characterized as including means for purging said conveying means after the fire has been extinguished by the conveyance of a fluidized quantity of chemical fire extinguishing agent through said conveying means.

13. A fire extinguishing apparatus as defined in claim 10 wherein said gas flow regulating means comprises a pressure regulator valve between said main gas source and said pressure vessel for developing a substantially constant pressure in the gas stream flowing from said pressure regulator valve to said pressure vessel and originating at said main gas source.

14. A fire extinguishing apparatus comprising:

a pressure vessel for containing a chemical fire extinguishing agent;

a first source of gas under pressure connected to said vessel;

a pressure regulator valve connected between said first source of gas and said pressure vessel for selectively regulating the pressure of gas delivered from said first source to said pressure vessel;

a second source of gas connected to said vessel, said second gas source including a supply of gas at a relatively higher pressure than the regulated pressure of gas from said first source;

discharge means connected to said pressure vessel for delivering said extinguishing agent; and a check valve positioned upstream from said pressure vessel and between said second source and said pressure regulator valve and responsive to the pressure of gas originating at said second source to sequentially communicate with the pressure vessel, initially the second source of gas and subsequently the first source of gas, whereby gas flows, at such subsequent time, at a constant pressure through said discharge means.

* * * * *